United States Patent [19]

Higashino et al.

[11] Patent Number: 4,696,721

[45] Date of Patent: Sep. 29, 1987

[54] ELECTROFORMING METHOD AND ELECTROFORMING APPARATUS

[75] Inventors: Hiroyuki Higashino, Yokohama; Hideki Ohkawa, Tokyo, both of Japan

[73] Assignee: Kabushiki Kaisha Toshiba, Kawasaki, Japan

[21] Appl. No.: 944,513

[22] Filed: Dec. 22, 1986

[30] Foreign Application Priority Data

Dec. 27, 1985 [JP] Japan ..... 60-293120
Feb. 13, 1986 [JP] Japan ..... 61-29304

[51] Int. Cl.[4] ..... C25D 1/00
[52] U.S. Cl. ..... 204/3; 204/237
[58] Field of Search ..... 204/3, 232, 237

[56] References Cited

FOREIGN PATENT DOCUMENTS 61-3894 1/1986 Japan ..... 204/3

OTHER PUBLICATIONS

A. F. Greene, vol. 55, Plating; 594 (1968).

*Primary Examiner*—T. M. Tufariello
*Attorney, Agent, or Firm*—Schwartz, Jeffery, Schwaab, Mack, Blumenthal & Evans

[57] ABSTRACT

An electroforming method comprising the steps of immersing a conductive matrix and an insoluble electrode having a high oxygen overvoltage, in an electroforming solution containing sulfamate ions, applying a voltage between said conductive matrix and insoluble electrode, to electrolyze said electroforming solution, depositing a metal layer on the surface of said matrix, and emitting electromagnetic radiation, having a wavelength shorter than 400 nm, to said electroforming solution. An electroforming apparatus comprising an electroforming tank holding an electroforming solution containing sulfamate ions, a conductive matrix and an insoluble electrode having a high oxygen overvoltage, both immersed in said electroforming solution, a power source for applying voltage between said conductive matrix and insoluble electrode having a high oxygen overvoltage, and a source of electromagnetic radiation for emitting electromagnetic radiation having a wavelength shorter than 400 nm.

23 Claims, 11 Drawing Figures

ELECTROFORMING METHOD AND ELECTROFORMING APPARATUS

BACKGROUND OF THE INVENTION

This invention relates to an electroforming method and an apparatus for performing said method.

An electroformed article, for example, a nickel stamper is manufactured through the following steps:

First, a conductive matrix and an insoluble electrode having a high oxygen overvoltage are immersed in a nickel sulfamate bath. Voltage is applied between the matrix and electrode, to electrolyze the solution of nickel sulfamate, thereby depositing a nickel layer on the surface of the matrix. A nickel stamper is produced by peeling the nickel layer off the matrix. The above-mentioned matrix is formed of, for example, a glass plate coated with a thin silver electrode. The aforementioned insoluble electrode is prepared from, for example, a platinum electrode (disclosed in patent disclosure 61-3894, 1986).

During the electroforming process, azodisulfonate (hereinafter abbreviated as "ADS") is generated through the anodic oxidation reaction of sulfamate ion, in accordance with the following formula (1) (A.F. Greene; Plating, 55, 594 (1968)).

$$2H_2NSO_3^- \rightarrow {}^-SO_3-N=N-SO_3^- + 4H^+ + 4e^- \quad (1)$$

After penetrating into an electroformed product, the above-mentioned ADS hardens and renders the product brittle. Moreover, once generated, ADS can not be decomposed by an oxidizing or reducing agent, or by heat treatment.

The drawbacks encountered until now, therefore, are that as integrated electric power is increased, the concentration of ADS in the electroforming solution is raised. Therefore, the more frequently the electroforming process is repeated, the harder and more brittle the resultant electroformed product. Finally, the problem arises in that the machining of the electroformed product is considerably difficult.

SUMMARY OF THE INVENTION

The present invention has been conceived in view of the above-mentioned circumstances, and is intended to decompose ADS generated during the electroforming process, thereby decreasing the content of ADS in an electroformed product.

Another object of the present invention is to decompose ADS according to the rate at which ADS is generated during the electroforming process, thereby enabling the manufacture of an electroformed product having a suitable hardness.

To attain the above-mentioned object, the present invention provides an electroforming method comprising the steps of:

- immersing a conductive matrix and an insoluble electrode having a high oxygen overvoltage, in an electroforming solution containing sulfamate ions;
- applying voltage between said conductive matrix and insoluble electrode, to electrolyze said electroforming solution;
- emitting electromagnetic radiation, shorter than 400 nm, to the electroforming solution.

The present invention also provides an electroforming apparatus comprising:

- an electroforming tank filled with an electroforming solution containing sulfamate ions;
- a conductive matrix and insoluble electrode having a high oxygen overvoltage, both being immersed in said electroforming solution;
- a power source for applying voltage between said conductive matrix and insoluble electrode having a high oxygen overvoltage; and
- a source of electromagnetic radiation for emitting electromagnetic radiation, having a wavelength shorter than 400 nm, to said electroforming solution.

The reason why the electromagnetic radiation emitted to the electroforming solution is defined to have a wavelength shorter than 400 nm is that electromagnetic radiation having a wavelength longer than 400 nm is not effective to decompose ADS.

DETAILED DESCRIPTION OF THE PREFERRED EMBODIMENTS

Description will now be made, with reference to the accompanying drawings, of an electroforming method and an apparatus embodying the present invention.

Figure 1:
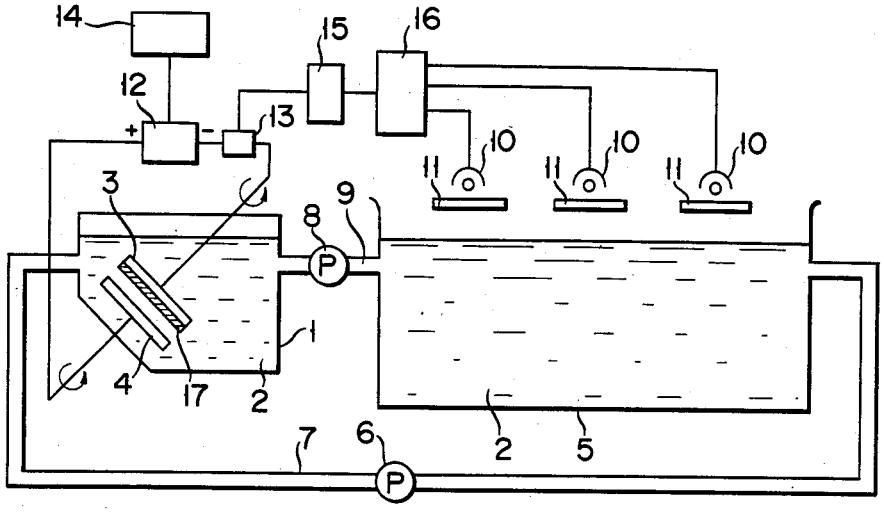
FIG. 1 is a sectional view of an electroforming apparatus embodying the present invention.

Referring to FIG. 1, nickel sulfamate solution 2 is contained in electroforming tank 1. Glass plate 3 whose surface is coated with a thin silver electrode, and insoluble platinum electrode 4 having a high oxygen overvoltage are immersed in nickel sulfamate solution 2. Further provided, separate from electroforming tank 1, is spare tank 5 also for holding nickel sulfamate solution 2. The outer side walls of both electroforming tank 1 and spare tank 5 are connected by pipe 7 provided with pump 6. The inner side walls of both electroforming tank 1 and spare tank 5 are connected by pipe 9 provided with pump 8. A plurality of mercury lamps 10 are set above spare tank 5. Filters 11 are provided between each mercury lamp 10 and the nickel sulfamate solution 2 held in spare tank 5. Filters 11 are formed of a material having the wavelength-selecting property capable of stopping unnecessary electromagnetic radiation having a wavelength above 400 nm.

Electroforming power source 12 and member 13 are connected between aforementioned glass plate 3 and platinum electrode 4. Power source controller 14 is connected to electroforming power source 12. Power source controller 15 and power source 16, for the mercury lamps, are connected between mercury lamps 10 and ammeter 13.

A nickel stamper is manufactured by the above-mentioned electroforming apparatus, in the following manner:

A thin silver electrode placed on glass plate 3 is used as a cathode, and platinum electrode 4 is used as an anode. When voltage is applied from electroforming power source 12, between said cathode and anode, nickel sulfamate solution 2 is electrolyzed. When the current density rises above 0.5 A/dm$^2$, a reaction indicated by the following formula (2) occurs, whereby nickel layer 17 is deposited on the surface of the thin silver electrode placed on glass plate 3.

$$Ni^{2+} + 2e^- \rightarrow Ni \quad (2)$$

Current flowing between glass plate 3 and platinum electrode 4 is detected by ammeter 13. A signal denoting the magnitude of the detected current is supplied to power source controller 15, for the mercury lamps, to control an output from power source 16 therefor, thus regulating the per unit time amount of electromagnetic radiation emitted through filters 11 of mercury lamps 10 to the nickel sulfamate solution 2 held in spare tank 5.

In this case, the integrated electroforming rate is proportional to the amount of current carried to the electrode. When, therefore, the per unit time amount of electromagnetic radiation is controlled in accordance with the current rate detected by ammeter 13, it is possible to control the integrated amount of electromagnetic radiation corresponding to the integrated electroforming rate. Emission of electromagnetic radiation decomposes ADS contained in electroforming solution 2, in accordance with the reaction described by the following formula (3):

$$^{-}SO_3-N=N-SO_3^- + H_2O \xrightarrow{\pm h\nu} N_2\uparrow + HSO_3^- + HSO_4^- \quad (3)$$

Consequently, the concentration of ADS in the nickel sulfamate solution 2 held in spare tank 5 can be set at an optimal level. Nickel sulfamate solution 2 whose ADS concentration has thus been controlled is carried smoothly into electroforming tank 1 through pipes 7, 9 by driving pumps 6, 8. Therefore, a nickel stamper 17 having a proper hardness can be formed on the thin silver electrode placed on glass plate 3 held in electroforming tank 1.

EXPERIMENT

To confirm the above-mentioned effect of the present invention, a nickel sulfamate solution was provided, in which ADS had already been generated, by means of several electroforming steps. In this experiment, a matrix formed of a Cu plate, instead of a glass plate coated with a thin silver electrode, was used. Thus, the plating of nickel on the Cu plate was tried.

An absorption spectrum was determined, by means of a UV spectrometer, with respect to two cases, when ultraviolet radiation was not emitted to a nickel sulfamate solution (control example) and also when ultraviolet radiation was emitted 20 times, for 30 seconds each time, by means of a mercury lamp of 12000 W (example of the present invention). In both cases, the amount of a nickel sulfamate solution was 500 ml.

Figure 2:
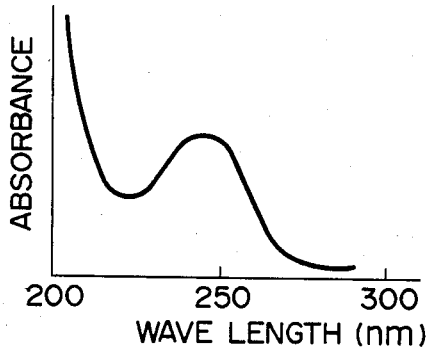
FIG. 2 illustrates the absorption spectrum of an electroforming solution of a control example (see "Experiment"), to which ultraviolet radiation is not emitted.
Figure 3:
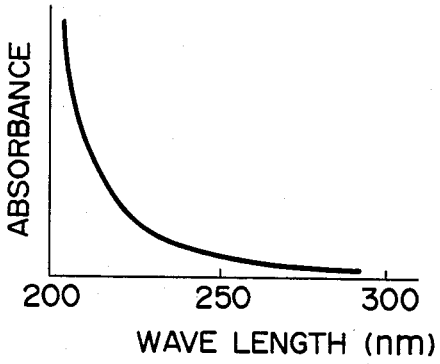
FIG. 3 shows the absorption spectrum of an electroforming solution of the example of the present invention (see "Experiment") to which ultraviolet radiation is emitted.

Table 1 below shows the absorbance at 245 nm, obtained in the control example (FIG. 2) and in the example of the present invention (FIG. 3).

TABLE 1

| | Frequency of emitting ultraviolet radiation | Absorbance ($\lambda$ = 245 nm) | Vickers hardness | Surface condition | pH value | |
|---|---|---|---|---|---|---|
| | | | | | Before plating | After plating |
| Control (FIG. 2) | 0 | 0.35 | 420 to 440 | Lustrous | 5.0 | 5.1 |
| Example (FIG. 3) | 20 | 0.03 | 270 to 320 | Cloudy | 4.7 | 4.8 |

FIGS. 2 and 3 and Table 1 show that in the example of the present invention, the peak at 245 nm, arising from the inclusion of ADS, is substantially eliminated.

Thereafter, a Cu plate and a platinum electrode were immersed in the solution used in the control example and in the example of the invention respectively, and nickel-plating was carried out under the following conditions:

| | |
|---|---|
| Temperature | 40° C. |
| Total current | 3 A |
| Time of plating | 10 min |

Figure 4A:
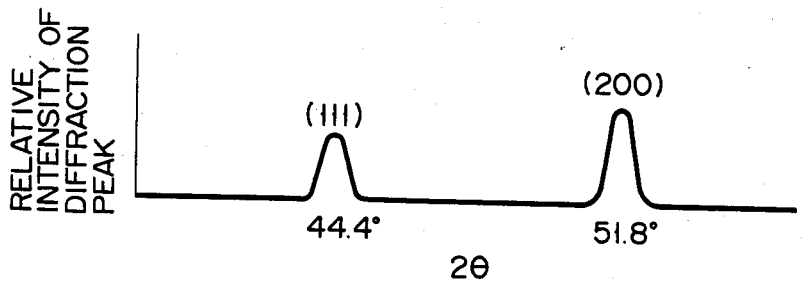
FIG. 4A is an X-ray diffraction chart of a Ni layer formed by the method of the control example.
Figure 4B:
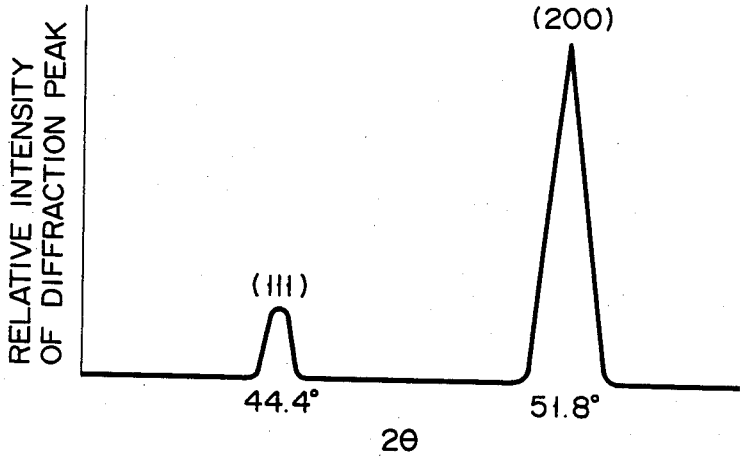
FIG. 4B is an X-ray diffraction chart of a Ni layer produced by the method of the example of the present invention.

The X-ray diffraction method was applied to check variations in the crystal planes with respect to the nickel plates thus formed (FIGS. 4A and 4B).

FIGS. 4A and 4B show that improvement is attained in respect of the orientation of the (200) planes of the nickel crystal of the example. It is therefore assumed that the emission of ultraviolet radiation leads to the decomposition of ADS detrimental to the growth of nickel crystal. Table 1 also indicates the Vickers hardness of nickel plates obtained, and their surface conditions, observed by the naked eye, and also the pH levels of the solution before and after plating. The Vickers hardness figures indicated herein represent values determined at those portions where current density stood at 9A/dm$^2$. In the foregoing experiment, it was found that the application of an excess load caused the measured values to be affected by the Cu plate. Therefore, the load was set at 50 g. When a load of 50 g was applied, the Vickers hardness of the Cu plate was 80. Table 1 also indicates that the Vickers hardness of the nickel plate was less in the example than in the control example.

The data in Table 1 proves that if the above-mentioned experiments are repeated frequently, and the relation is determined, in advance, between the generation of ADS and the magnitude of the Vickers hardness of an electroformed product, on the basis of the integrated amount of electroforming current and of electromagnetic radiation, then it is possible to manufacture an electroformed article having an optimal level of the Vickers hardness, by controlling the integrated amount of emitted electromagnetic radiation in accordance with the integrated amount of electroforming current.

The present invention is not limited to the above-mentioned example, but may be practiced using various modifications thereof. In the electroforming apparatus of FIG. 1, for example, electromagnetic radiation is emitted to the electroforming solution 2 held in spare tank 5. Alternatively, electromagnetic radiation may be supplied to the electroforming solution 2 contained in electroforming tank 1.

In the electroforming apparatus of FIG. 1, mercury lamps 10, a source of electromagnetic radiation, are set above spare tank 5. Since, however, spare tank 5 holds a large amount of electroforming solution 2, the decomposition of ADS tends to be reduced.

Figure 5:
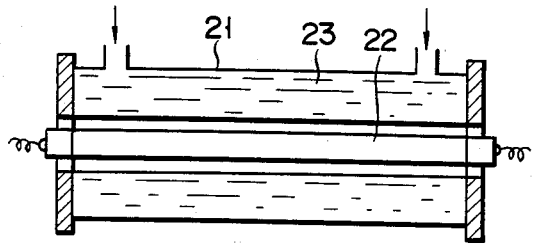
FIG. 5 is a sectional view illustrating the method of emitting electromagnetic radiation to an electroforming solution, in a first modification of the present invention.

For the object of decomposing ADS effectively, therefore, it may be advisable, as is shown in FIG. 5, to set lamp 22 in the hollow space of cylindrical spare tank 21 prepared from, for example, quartz glass, thereby emitting electromagnetic radiation to electroforming solution 23 flowing through spare tank 21.

Figure 6:
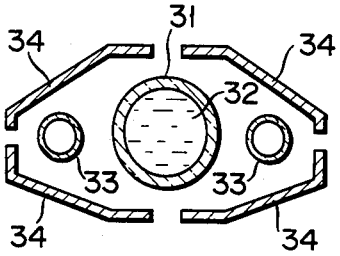
FIG. 6 is a sectional view showing the method of emitting electromagnetic radiation to an electroforming solution, in a second modification of the present invention.

Further, as is illustrated in FIG. 6, it is possible to let electroforming solution 32 flow through quartz glass tube 31, to set lamps 33 around said quartz glass tube 31, and to surround all the members with reflection boards 34.

Electromagnetic radiation having a shorter wavelength than 200 nm is readily absorbed in an aqueous solution. When, therefore, such electromagnetic radiation is applied, ADS contained in the electroforming solution is unlikely to be fully decomposed.

Figure 7:
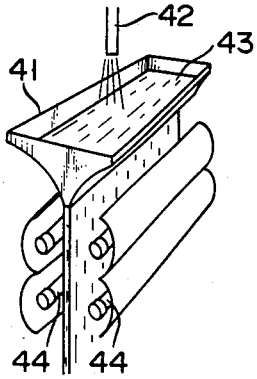
FIG. 7 is an oblique view illustrating the method of emitting electromagnetic radiation to an electroforming solution, in a third modification of the present invention.
Figure 8:
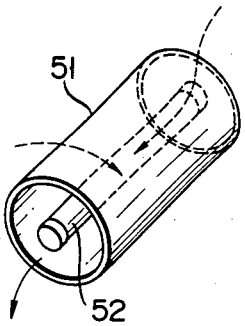
FIG. 8 is an oblique view illustrating the method of emitting electromagnetic radiation to an electroforming solution, in a fourth modification of the present invention.
Figure 9:
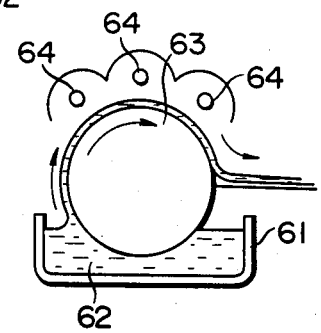
FIG. 9 is a sectional view showing the manner in which electromagnetic radiation is emitted to an electroforming solution, in a fifth modification of the present invention.

As means for resolving the aforementioned drawbacks, as can be seen from the embodiments of FIGS. 7 to 9, the more effective decomposition of ADS may be ensured by emitting electromagnetic radiation to an electroforming solution while it is flowing in the form of a liquid film.

The embodiment of FIG. 7 is characterized in that electroforming solution 43 is introduced into spare tank 41, having funnel-like section, through feed pipe 42, and electromagnetic radiation is emitted from lamps 44 while supplying electroforming solution 42, from the bottom portion of spare tank 41, in the form of a liquid film.

In the embodiment of FIG. 8, lamp 52 is set in the central portion of tube 51, and electroforming solution 53 is let flow through rotating tube 51, in the form of a liquid film. Electromagnetic radiation is emitted from lamp 52.

In the embodiment of FIG. 9, the lower portion of roller 63 is dipped in electroforming solution 62 held in spare tank 61. A liquid film of electroforming solution 62 is spread over the surface of roller 63, by the rotation of the roller. Lamps 64 set above roller 63 emit electromagnetic radiation to this liquid film.

Figure 10:
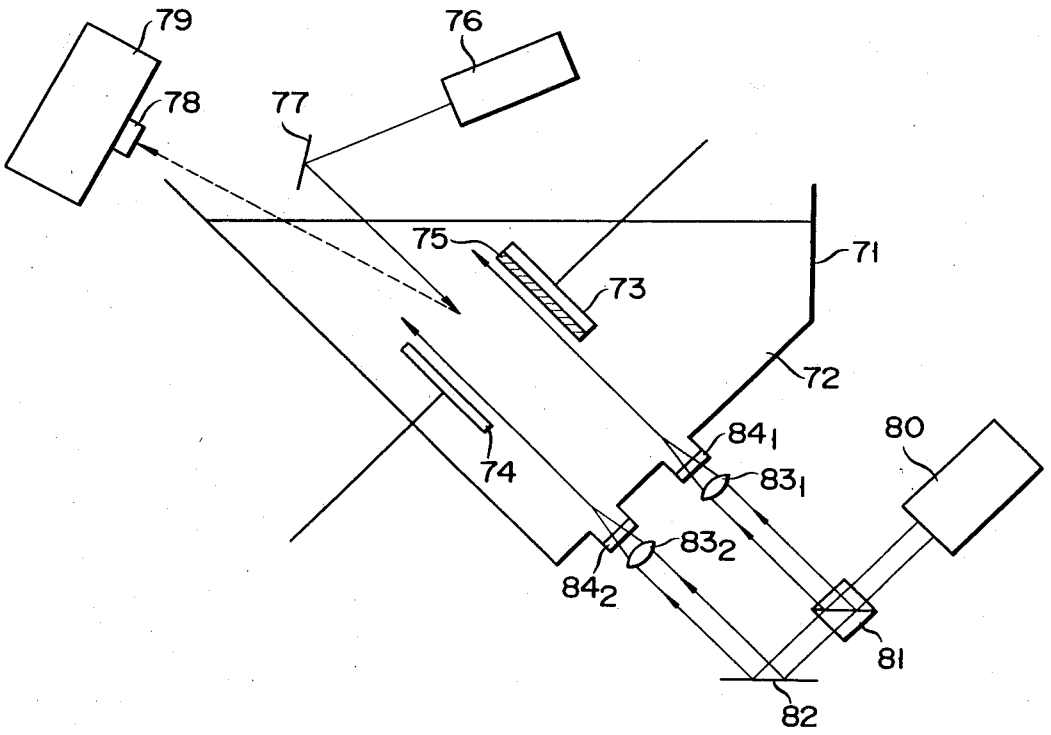
FIG. 10 is a sectional view illustrating the Raman scattering light-detecting process, used in a sixth modification of the present invention.

Further, as is shown in FIG. 10, an excimer laser may be used as a source of electromagnetic radiation. Also, it is possible to provide means for quantitatively analyzing the concentration of ADS generated.

Referring to FIG. 10, nickel sulfamate solution 72 is held in electroforming tank 71. Glass plate 73, coated with a thin silver electrode acting as a cathode, and platinum electrode 74, acting as an anode, are immersed in said electroforming solution, i.e., nickel sulfamate solution 72. Electroforming solution 72 is circulated through a pump-filter system (not shown). Nickel layer 75 is deposited on said glass plate 73.

Above electroforming tank 71 is an optical system consisting of KrF laser 76, mirror 77, detector 78, and Raman spectrometer 79, which are provided in order to detect and quantitatively analyze the concentration of ADS contained in electroforming solution 72. The laser beam emitted from KrF laser 76 is reflected by mirror 77, and emitted to that portion of nickel sulfamate solution 72 which lies between glass plate 73 and platinum electrode 74. If, in this case, ADS is generated, Raman scattering light for ADS appears. Raman scattering light is analyzed by detector 78 and Raman spectrometer 79. The concentration of ADS is quantitatively analyzed by the resultant spectroscopic data.

Further, an optical system is provided below electroforming tank 71, for the decomposition of ADS contained in the electroforming solution. This optical system comprises excimer laser 80, beam splitter 81, mirror 82, lenses $\mathbf{83}_1$, $\mathbf{83}_2$, and quartz windows $\mathbf{84}_1$, $\mathbf{84}_2$. Quartz windows $\mathbf{84}_1$, $\mathbf{84}_2$ are fitted to the underside of electroforming tank 71. A control system (not shown), similar to that shown in FIG. 1, is connected between the excimer laser and a pair of electrodes. The portion of the laser beam, emitted excimer laser 80, which is reflected by beam splitter 81, passes through lens $\mathbf{83}_1$ and quartz window $\mathbf{84}_1$, and is emitted to that portion of electroforming solution 72 which lies near (within 50 mm from) the surface of glass plate 73. On the other hand, that portion of the laser beam, emitted from excimer laser 80, which passes through beam splitter 81, is reflected by mirror 82, and passes through lens $\mathbf{83}_2$ and quartz window $\mathbf{84}_2$, and is finally emitted to that portion of electroforming solution 72 which lies near (within 50 mm from) the surface of platinum electrode 74.

The above-described apparatus can quantitatively analyze the ADS concentration in an electroforming solution, by use of the Raman spectroscopic process. It will be noted that when an excimer laser is utilized as a source of laser beam, it is not necessary to provide a filter.

Throughout the aforementioned embodiments, an insoluble electrode having a high oxygen overvoltage has been prepared from a platinum-base material. However, this electrode may be formed of a material containing palladium, iridium, rhodium, or graphite.

Throughout the aforementioned embodiments, an electroforming solution has contained Ni ion. However, this electroforming solution may contain a cation consisting of at least one selected from the group of Co ion, In ion, Fe ion, Cu ion, Cr ion, Mn ion, Zn ion, Ru ion, Rh ion, Ag ion, Cd ion, Sn ion, Sb ion, Te ion, Re ion, Os ion, Ir ion, Pt ion, Au ion, Hg ion, Pb ion, and Bi ion.

The foregoing description refers to the case where the present invention has been applied to an electroforming process. Obviously, as is shown by the experiment, the present invention is also applicable to an electroplating process.

What is claimed is:

1. An electroforming method comprising the steps of immersing a conductive matrix and an insoluble electrode having a high oxygen overvoltage, in an electroforming solution, containing sulfamate ions, which is held in an electroforming tank, applying voltage between said conductive matrix and insoluble electrode, to electrolyze said electroforming solution, thereby to deposit a metal layer on the surface of said matrix, wherein electromagnetic radiation, having a wavelength shorter than 400 nm, is emitted to said electroforming solution.

2. The electroforming method according to claim 1, wherein said electromagnetic radiation is emitted to an electroforming solution held in said electroforming tank.

3. The electroforming method according to claim 1, wherein said electroforming solution is circulated between the electroforming tank and a spare tank.

4. The electroforming method according to claim 3, wherein said electromagnetic radiation is emitted to the electroforming solution held in said spare tank.

5. The electroforming method according to claim 1, wherein said electroforming solution is converted into a liquid film, outside of the electroforming tank, and wherein said electromagnetic radiation is emitted to said liquid film.

6. The electroforming method according to claim 1, wherein said electroforming solution contains a cation consisting of at least one selected from the group of Ni ion, Co ion, In ion, Fe ion, Cu ion, Cr ion, Mn ion, Zn ion, Ru ion, Rh ion, Ag ion, Cd ion, Sn ion, Sb ion, Te ion, Os ion, Ir ion, Pt ion, Au ion, Hg ion, Pb ion, and Bi ion.

7. The electroforming method according to claim 1, wherein said matrix is a glass plate coated with a thin silver electrode.

8. The electroforming method according to claim 1, wherein said insoluble electrode is formed of platinum, palladium, iridium, rhodium, or graphite.

9. The electroforming method according to claim 1, wherein the current density of said insoluble electrode is defined to be higher than 0.5 $A/dm^2$.

10. The electroforming method according to claim 1, wherein said electromagnetic radiation consists of laser beam having a wavelength shorter than 300 nm.

11. The electroforming method according to claim 1, wherein the integrated emission rate of said electromagnetic radiation is controlled in accordance with the integrated rate of current supplied between said matrix and insoluble electrode.

12. The electroforming method according to claim 1, wherein the concentration of azodisulfonate in said electroforming solution is quantitatively determined from the intensity of Raman scattering light emitted from said electroforming solution.

13. An electroforming apparatus comprising:

an electroforming tank holding an electroforming solution containing sulfamate ions;

a conductive matrix and an insoluble electrode having a high oxygen overvoltage, both immersed in said electroforming solution;

a power source for applying voltage between the conductive matrix and the insoluble electrode having a high oxygen overvoltage; and a source of electromagnetic radiation for emitting electromagnetic radiation, having a wavelength shorter than 400 nm, to said electroforming solution.

14. The electroforming apparatus according to claim 13, which further comprises a spare tank, with circulation pumps and pipes provided between said electroforming tank and spare tank.

15. The electroforming apparatus according to claim 14, wherein said spare tank consists of a cylindrical tank, and wherein said source of electromagnetic radiation is set in a hollow region provided in said cylindrical tank.

16. The electroforming apparatus according to claim 14, wherein said spare tank consists of a tubular tank, and wherein sources of electromagnetic radiation and reflectors are positioned around the outer periphery of said tubular tank.

17. The electroforming apparatus according to claim 14, wherein said spare tank has a funnel-shaped cross section, and wherein sources of electromagnetic radiation are arranged around liquid film-shaped electroforming solutions flowing downward from the bottom of said spare tank.

18. The electroforming apparatus according to claim 13, which further comprises a rotary tube enabling an electroforming solution to flow down the inner wall, in the form of a liquid film, and wherein said source of electromagnetic radiation is held in said tube.

19. The electroforming apparatus according to claim 13, which further comprises a roller having a peripheral wall capable of converting an electroforming solution into a liquid film, upon rotation of said roller, and wherein sources of electromagnetic radiation are set on the outer peripheral wall of said roller.

20. The electroforming apparatus according to claim 13, wherein said source of electromagnetic radiation consists of mercury lamps, and which further comprises wavelength-selective filters provided between said mercury lamps and electroforming solution.

21. The electroforming apparatus according to claim 13, wherein said source of electromagnetic radiation consists of a laser for emitting laser beam having a wavelength shorter than 300 nm.

22. The electroforming apparatus according to claim 21, wherein said laser is KrF excimer laser.

23. The electroforming apparatus according to claim 13, which further comprises a Raman spectrometer for detecting Raman scattering light emitted from said electroforming solution.

* * * * *